US006149070A

United States Patent [19]

Hones

[11] Patent Number: 6,149,070

[45] Date of Patent: Nov. 21, 2000

[54] WATERFALL DEVICE

[76] Inventor: William G. Hones, 17953 Marine View Dr., Seattle, Wash. 98166

[21] Appl. No.: 09/239,670

[22] Filed: Jan. 29, 1999

[51] Int. Cl.[7] ..... B05B 17/08

[52] U.S. Cl. ..... 239/17; 239/16; 239/18; 239/20; 239/23; 239/193; D23/201

[58] Field of Search ..... 239/16, 17, 18, 239/20, 23, 193; 40/406, 407, 410; 261/37; D23/201

[56] References Cited

U.S. PATENT DOCUMENTS

| | | | |
|---|---|---|---|
| 1,689,790 | 10/1928 | LeFevre, Jr. . | |
| 1,837,225 | 12/1931 | Lipski . | |
| 3,174,688 | 3/1965 | Chatten | 239/20 |
| 4,747,538 | 5/1988 | Dunn et al. . | |
| 4,881,280 | 11/1989 | Lesikar . | |
| 5,167,368 | 12/1992 | Nash | 239/17 |
| 5,226,935 | 7/1993 | Wolff et al. | 239/20 X |
| 5,445,322 | 8/1995 | Formhals et al. | 239/18 |
| 5,537,696 | 7/1996 | Chartier . | |
| 5,571,409 | 11/1996 | Scarborough | 239/20 X |
| 5,738,280 | 4/1998 | Ruthenberg . | |

FOREIGN PATENT DOCUMENTS

| | | | |
|---|---|---|---|
| 2185541 | 7/1987 | United Kingdom | 239/17 |

*Primary Examiner*—Andres Kashnikow
*Assistant Examiner*—Robin O. Evans
*Attorney, Agent, or Firm*—Blank Rome Comisky & McCauley

[57] ABSTRACT

A decorative and educational waterfall device has a substantially continuous film of a liquid, such as water, low viscosity oil or an aqueous solution, extending between two vertically upstanding guides. The waterfall comprises a base reservoir in which is mounted an electrical pump. A tower containing a liquid flow passage is mounted to the base and a trough having two side walls and a bottom wall which terminates in a lip portion at the front edge of the trough is mounted to the tower so that liquid from the tower flows over the bottom wall and lip portion of the trough to form the waterfall between the two upstanding guides. One or more flow restrictors are mounted transversely across the trough, substantially parallel to the lip portion to decrease the turbulence of the flowing liquid and improve the capability of the liquid to form a continuous film.

25 Claims, 6 Drawing Sheets

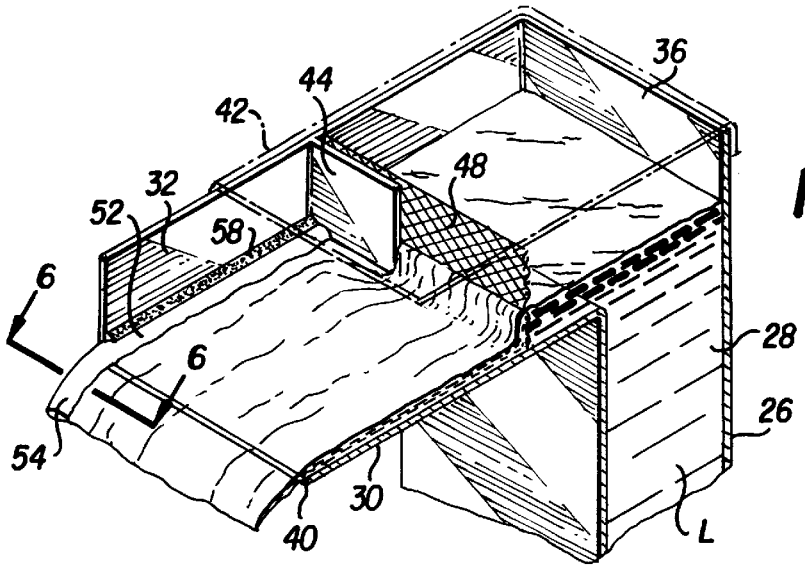
FIG. 4
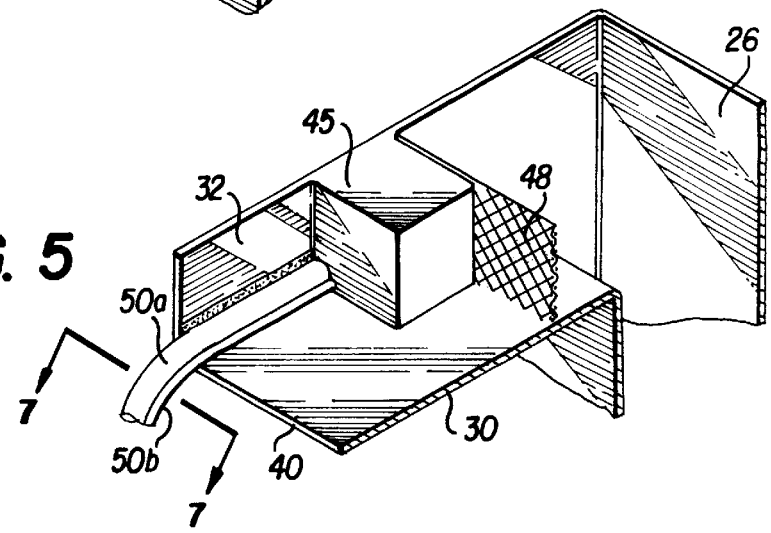
FIG. 5
FIG. 6
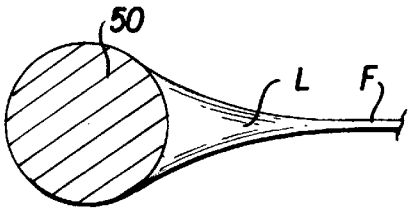
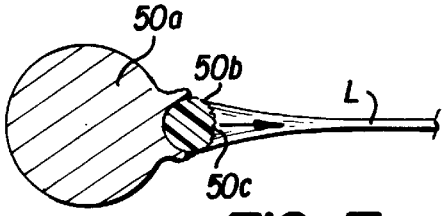
FIG. 7
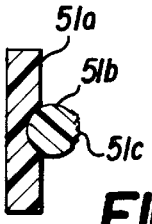
FIG. 8

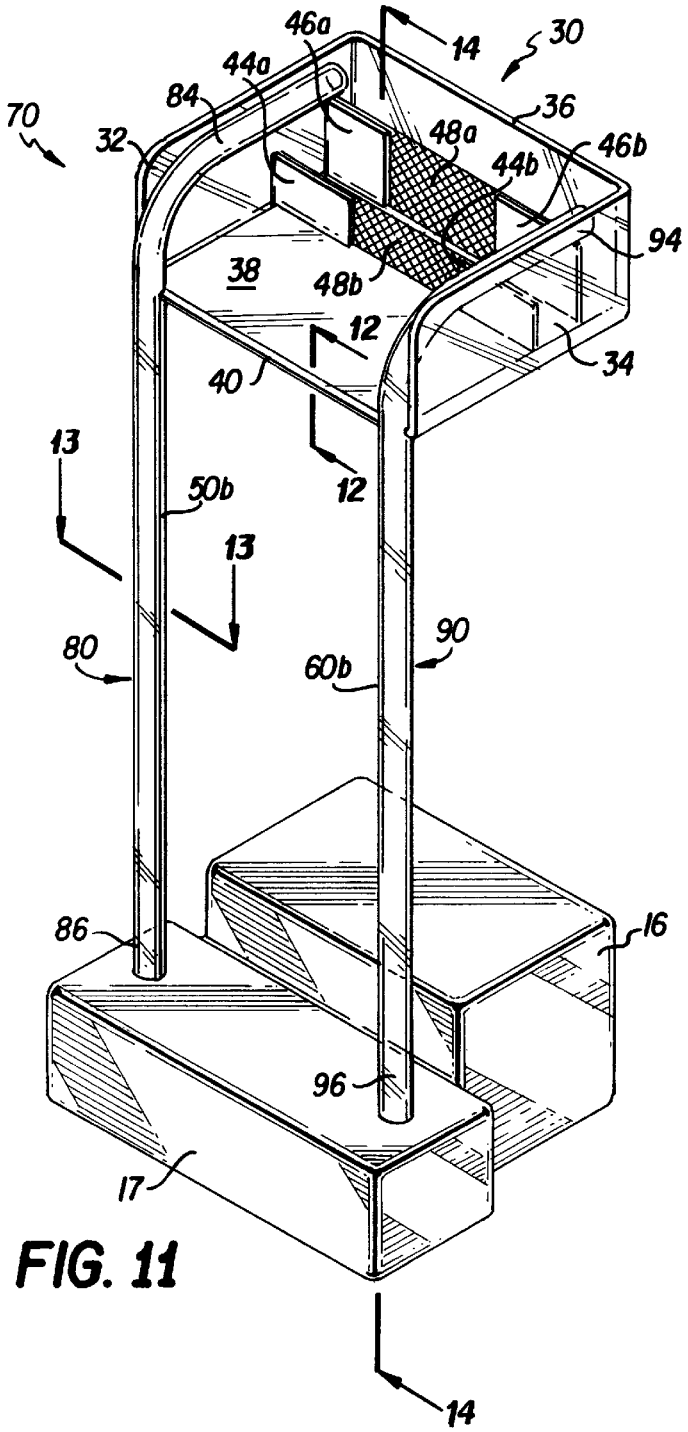
FIG. 11
FIG. 13
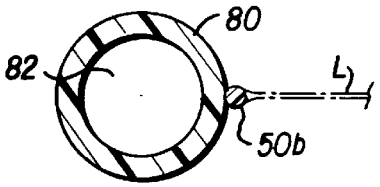
FIG. 12
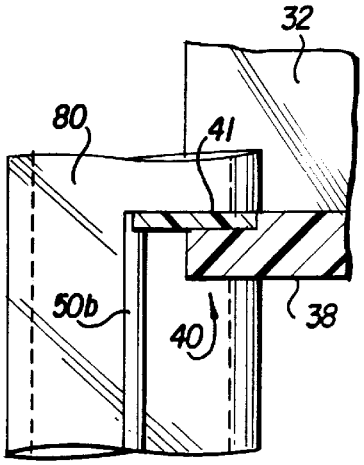

WATERFALL DEVICE

FIELD OF THE INVENTION

The present invention relates to decorative and educational displays of a flowing liquid and more particularly to a decorative and educational waterfall device in which a substantially continuous film of a liquid, such as water, low viscosity oil or an aqueous solution, extends between two vertical guides.

BACKGROUND OF THE INVENTION

Conventional decorative water or waterfall displays are typically constructed for indoor or outdoor use in pools, spas or the like. These water or waterfall displays generally use a plurality of water chambers and wide, flat spouts to create thick and discontinuous streams of water that fall a short distance into the pool or spa below. One of the problems with such devices is that they are primarily designed for use with large volumes of water, which makes it difficult to use the devices in indoor water displays. Moreover, such prior art waterfall displays do not form a continuous film or layer of downwardly flowing water, but rather form thick, turbulent streams which tend to splash and are not particularly attractive as a decorative display. Additionally, the waterfall produced by such devices tends to separate into one or more generally cylindrical streams of water as it falls because of the strong surface tension of water that tends to pull the water flow together. Examples of such devices are disclosed in U.S. Pat. Nos. 4,881,280 to Lesikar; 5,537,696 to Chartier; and 5,738,280 to Ruthenberg.

Decorative indoor water displays are known in the art. However, the known indoor water displays do not create an unsupported film or laminar sheet of water. Instead, such displays are characterized by flowing water over a solid or broken solid surface, such as an inclined or vertical plate. The water adheres to the plate surface as it cascades down. Such displays do not create a transparent film of water, but merely flow water over an existing structure to create a rippling effect. An example of such a device is disclosed in U.S. Pat. No. 4,747,583 to Dunn et al.

Indoor displays that are used to advertise oil are known in the art. One of the problems associated with the existing advertising display devices is that in order to function, they require the use of viscous fluids, such as lubricating oil. U.S. Pat. No. 1,689,790 to Lefevre, Jr. discloses an oil display device. Lefevre, Jr. however, is limited to maintaining a thin film of viscous liquid. The device relies on the high viscosity of the liquid displayed to create a film. Another problem associated with the Lefevre, Jr. device is that in order to maintain contact between the viscous liquid and two guides, it relies on forming the guides such that they converge at the bottom of the device. As a result of these deficiencies, the device disclosed would not be able to maintain a film of aqueous liquid. Similarly, U.S. Pat. No. 1,837,225 to Lipski discloses an oil display device for displaying cyclic movement of an oil film, and is adapted for use only with lubricating oils and other liquids with high molecular adhesion. The Lipski device is similarly not suited for low viscosity liquids, such as water or aqueous liquids which have low molecular adhesion and high molecular cohesion.

The devices disclosed in the aforementioned patents suffer from many deficiencies as described above. It would be desirable, therefore, to provide a decorative and educational indoor waterfall which utilizes a low viscosity liquid, such as water or other aqueous liquid, to form an attractive display of a continuous liquid film between two limiting guides. From the standpoint of education, it would be desirable to provide a waterfall device that is not only decorative, but also is suitable for use as a demonstrative aid in teaching the physics of liquid flow, surface tension and other hydrodynamic concepts.

SUMMARY OF THE INVENTION

In view of the foregoing limitations of the prior art devices, as well as other disadvantages not specifically mentioned above, it should be apparent that there exists a need in the art for an indoor waterfall which can be used for decorative and educational purposes as well as for humidifying a space. It is therefore a primary objective of this invention to fulfill those needs by providing a decorative waterfall device that forms an attractive, substantially continuous film of water or aqueous liquid between a pair of vertically upstanding guides and that can be used educationally to explain hydrodynamic concepts.

It is also an objective of the present invention to provide a decorative waterfall in which a readily available liquid, such as water or other aqueous liquid, can be used to create an attractive waterfall device with a continuous liquid film.

It is a further objective of the present invention to provide a decorative waterfall device which is easily maintained such that the device does not require the cleaning of slippery, messy lubricating oils from the device and its surroundings.

It is an additional object of the present invention to provide a pleasant, unique and attractive decoration suitable for indoor or outdoor use.

Still another objective of the present invention is to provide a waterfall device that can be used to humidify the air in the space surrounding the waterfall device.

Yet another object of the present invention is to create a soothing environment with the soft susurrus of water.

A further object of the invention is to provide an interactive educational device for teaching fluid dynamics concepts, such as surface tension, laminar and turbulent flow and the like.

It is another objective of the invention is to provide a decorative waterfall device with a light source for illuminating a continuous water film or for projecting an image onto the film to enhance the attractiveness and utility of the waterfall device.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 4 is a fragmentary perspective view of the first embodiment of the waterfall device of the present invention, illustrating the flow of the water through the waterfall device;

FIG. 5 is a fragmentary perspective view of the first embodiment of the waterfall device of the present invention, illustrating an alternate embodiment of certain components of the waterfall device;

FIG. 6 is a transverse cross-section of the liquid guide of the present invention shown in FIG. 4, taken along line 6—6;

FIG. 7 is a transverse cross-section of the liquid guide of the present invention shown in FIG. 5, taken along line 7—7;

FIG. 8 is a transverse cross-section of an alternate embodiment of the liquid guide of the present invention;

FIG. 11 is a perspective view of the second embodiment of the waterfall device of the present invention;

FIG. 12 is a fragmentary cross-sectional detail of an alternate embodiment of the trough lip of the present invention taken along line 12—12 of FIG. 11;

FIG. 13 is a transverse cross-section of the tubular guide of the second embodiment of the present invention taken along line 13—13 of FIG. 11;

DETAILED DESCRIPTION OF THE INVENTION

Figure 1:
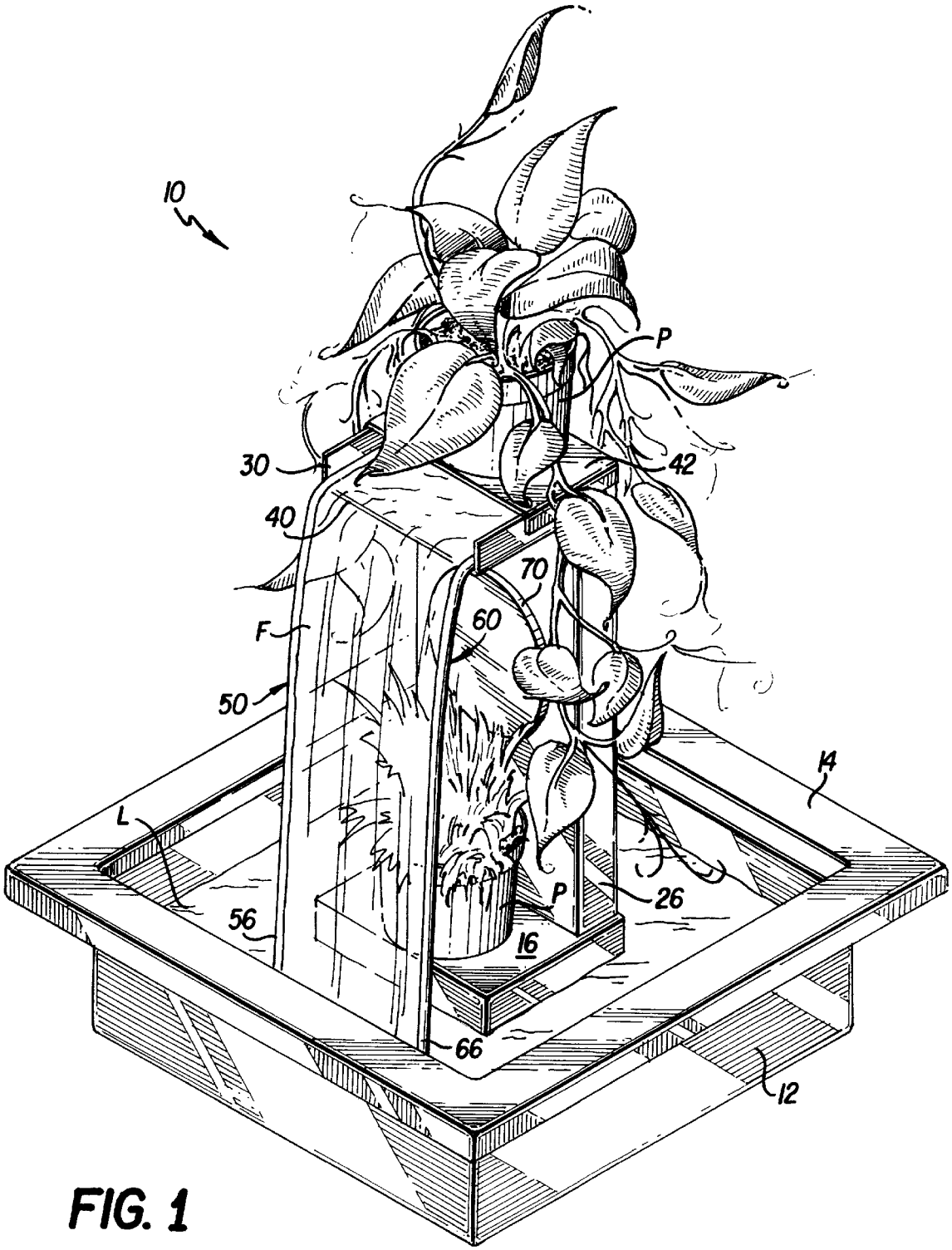
FIG. 1 is a perspective view of the first embodiment of the decorative waterfall device of the present invention, illustrating the waterfall device in use and decorated with plants.
Figure 3:
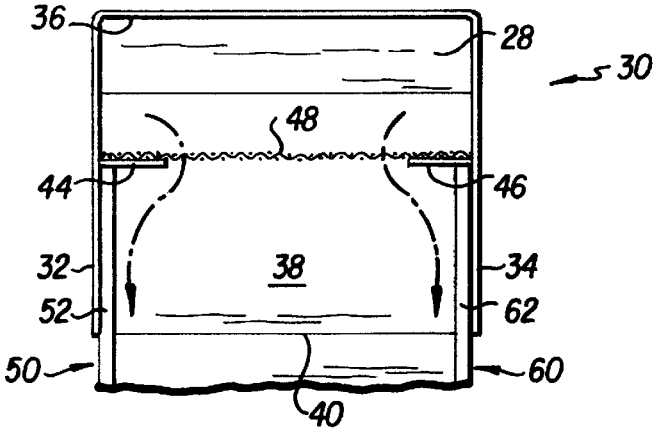
FIG. 3 is a top view of the first embodiment of the waterfall device of the present invention with the top cover removed, illustrating the water flow over the top surface or trough of the waterfall device.

Reference will now be made in detail to the preferred embodiments of the invention illustrated in the accompanying drawings, wherein like parts are designated by like numerals throughout. FIGS. 1–16 illustrate exemplary embodiments of the waterfall device of the invention which is designated generally in FIG. 1 by reference numeral 10.

A unique physical property of water is its very high surface tension compared with the surface tension of other liquids. Surface tension is that property of liquids arising from unbalanced molecular cohesive forces at or near the surface, as a result of which the surface tends to contract. For example, surface tension keeps water droplets whole instead of allowing the water to spread out as a film. Likewise, surface tension pulls a broad stream of water at the opening of a faucet into a more narrow stream as it falls from the faucet. Because of the high surface tension of water and aqueous liquids, it is extremely difficult, if not impossible to maintain a film of water, for example, in an annular ring or between a pair of wires or rods. In contrast, it is relatively easy to create a film of oil in an annular ring or between a pair of wires or rods. A surfactant, such as a liquid soap, is typically necessary to reduce the surface tension of water sufficiently to permit the formation of a thin aqueous liquid film, such as an aqueous soap solution used for blowing bubbles.

Another physical property unique to water is its low viscosity. Viscosity is the measure of the degree to which a fluid resists flow under an applied force. The viscosity of water is very low, for example at 15° C. and 16° C., the viscosity of water is 1.1 centipoise. In contrast, the viscosity of light machine oil at 15.6° C. is 113.8 centipoise. Similarly, heavy machine oil has a viscosity at 15.6° C. of 660.8 centipoise. The high viscosity of oil allows the oil to form a continuous film in an annular ring or between a pair of wires or rods Water alone, with its very low viscosity, cannot maintain a continuous film in an annular ring or between a pair of wires or rods.

Figure 2:
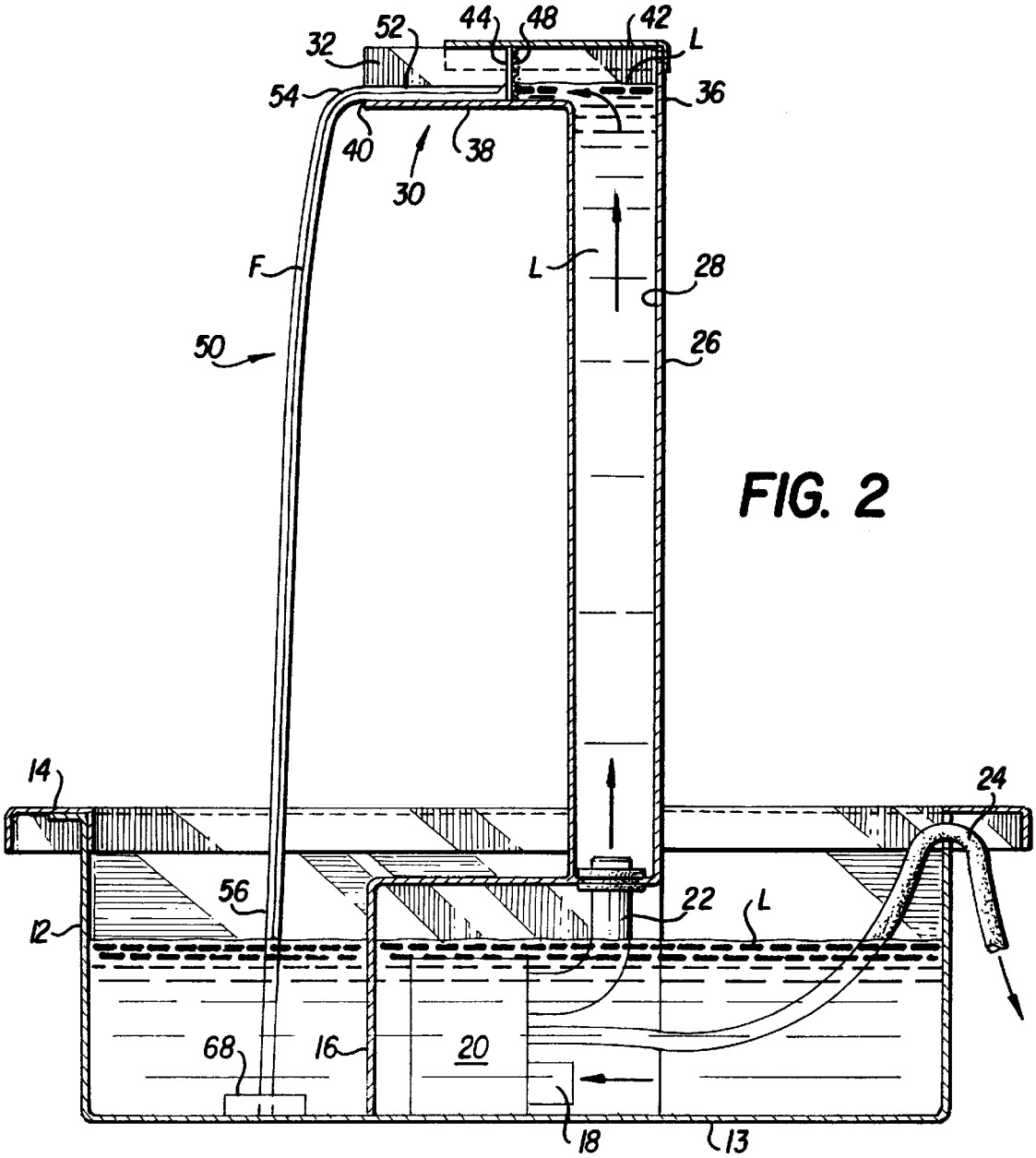
FIG. 2 is a side elevation view in cross-section of the first embodiment of the waterfall device of the present invention, taken along line 2—2 of FIG. 9.

Referring now in detail to FIGS. 1–4, a preferred embodiment of the waterfall 10 is illustrated in operation. The waterfall 10 comprises a base reservoir 12 formed with a flange or sill 14, in which is mounted a pump housing 16 partly submerged in water or an aqueous liquid L contained in the base reservoir 12. Located within the pump housing 16 is a liquid inlet 18, pump 20 and pump outlet conduit 22 (FIG. 2). Extending from the pump housing 16 is a power cord 24 adapted to be connected to a suitable source of electrical energy for the pump, e.g., household 110 volt power. A tower 26, containing a tower flow passage 28 through which water or aqueous liquid L can flow, is mounted to the top of pump housing 16 overlying the pump outlet conduit 22 and extends upwardly for a distance of up to about 24 inches. The tower 26 is mounted and sealed to the pump housing 16 in such a manner as to allow water or aqueous liquid L to pass from the pump outlet 22 through the tower passage 28 without leaking from the tower 26.

Mounted to the top of tower 26 is a water trough 30. The trough 30 has two side walls 32, 34, a rear wall 36, and a bottom wall 38 which terminates in a lip portion 40 at the front end of the trough 30. A trough cover 42 rests on the side walls 32, 34 and rear 36 walls of the trough 30, on which cover 42 as well as pump housing 16 maybe situated decorative items such as plants P, as illustrated in FIG. 1.

One or more flow restrictors 44, 46 and a screen 48 are mounted transversely across the trough 30 as shown in FIG. 2, substantially parallel to the lip portion 40, such that the restrictors 44, 46 and screen 48 are located in the flow path of the water or aqueous liquid L. It has been found that the restrictors 44, 46 and screen 48 decrease the turbulence of the flowing liquid L and improve the capability of the water or aqueous liquid to form a continuous film.

It is contemplated that, within the scope of the invention, more than one screen 48 and more than one pair of restrictors 44, 46 may be utilized. The restrictors 44, 46 and screen 48 decrease the turbulence and any eddy currents in the flow of water or aqueous liquid L such that substantially laminar or non-turbulent flow of the water or aqueous liquid L is achieved. It is contemplated that any turbulence dampening members, such as screens, restrictors and/or gates mounted to the trough 30, may be used to decrease the turbulence of the water or aqueous liquid L to provide the desired laminar or non-turbulent flow.

Two guide elements 50, 60 having respective upper end portions 52, 62, intermediate arcuate portions 54, 64 and lower end portions 56, 66, are mounted to the trough 30 at their upper end portions 52, 62. The guide elements 50, 60 are preferably cylindrical and should have a diameter which insures the guide elements are sufficiently rigid to withstand the surface tension forces and support the film. Diameters of about 0.125 inches or more have been found to be sufficient. In one embodiment, the guide elements 50, 60, may be mounted to the side walls 32, 34 by guide holders 58 (only one shown in FIG. 4). The guide elements 50, 60 extend from the lip portion 40 of the trough 30 downwardly into the base reservoir 12, such that the lower portions 56, 66 of the guide elements 50, 60 engage a guide spacer 68 suitably fixed to the bottom wall 13 of base 12 adjacent the pump housing 16.

Water or other aqueous liquid L fills the base reservoir 12 and is pumped by pump 20 along a flow path from the base reservoir 12, into the pump housing 16, through the liquid inlet 18 of the pump, out the pump outlet conduit 22, up through the tower flow passage 28 to the rear portion of the trough 30. The liquid L then flows over the trough 30, around the restrictors 44, 46, through screen 48, and over the lip portion 40 of the trough 30. The liquid L contacts and adheres to the guide elements 50, 60, maintaining a continuous film F of aqueous liquid L between the guide elements 50, 60 from the arcuate guide portions 54, 64 at lip portion 40, to the lower end portions 56, 66 of the guide elements, until the liquid film F contacts the surface of the water or aqueous liquid L filling the base reservoir 12. In this manner, the aqueous liquid L is continuously recycled, and maintains a continuous liquid film F between the guide elements 50, 60.

It is contemplated that the component parts of the waterfall 10 may be manufactured from a metal or plastic which will not oxidize or corrode when in contact with an aqueous liquid for extended periods of time, such as stainless steel, or acrylic or polycarbonate plastic. Alternatively, the waterfall 10 may be manufactured from a metal, such as copper, which oxidizes when in contact with air and water or aqueous liquid L for extended periods. The copper, upon oxidizing, will develop a blue or green patina, which will enhance the decorative aspect of the waterfall 10.

It is further contemplated that certain low viscosity oils may be used in lieu of water or aqueous liquid L. Alternatively, additives such as coloring agents, may be added to water to create a colored film F of aqueous liquid L. After the addition of, for example, a coloring agent, it is contemplated that the aqueous liquid film F may will change color. The liquid film may remain clear and transparent, or may be translucent or opaque. The additives should not substantially increase the viscosity of the aqueous liquid L.

It is also contemplated that aqueous liquid L may flow from the pump outlet 22 to the trough 30 by any number of liquid flow members. Although a tower 26 is one preferred embodiment, rubber tubing, or a series of hollow tubes of any shape may be used as a conduit for liquid L between the pump outlet 22 and the trough 30. Alternatively, it is contemplated that the waterfall 10 can maintain a continuous liquid film F from a liquid source (not shown) located above the waterfall 10. For example, water from a faucet might be directed or piped onto the trough 30 so that no pump is necessary to operate the waterfall 10 with a continuous liquid film F between the guide elements 50, 60.

In one embodiment of the tower 26, illustrated in FIG. 1, a light fixture 70 is located on the tower 26 adjacent to the liquid film F. It is contemplated that the light fixture 70 (not shown in detail) could be comprised of a light source, lens member and image transparency, which are arranged such that a visible image is projected from the transparency onto the liquid film F as described in more detail hereinafter in connection with FIG. 16.

Referring now to FIGS. 5–8, there are shown in greater detail alternate preferred embodiments of the trough 30 and guide elements 50, 60. In one preferred embodiment, the guide elements 50, 60 are each (only one shown) comprised of an outer guide element 50*a* and an inner guide element 50*b*, the inner guide element 50*b* having a roughened surface 50*c* (FIG. 7) for a purpose to be described. At least one of the inner guide elements 50*b* of the guide elements 50, 60 may be formed from an acrylic rod or tube or fiber optical cable and functions as a light guide. It is contemplated that restrictors 44, 46 may be constructed with a light source 45 (FIG. 5) to illuminate the ends of inner light guide elements 50*b*. Light source 45 maybe located at the bottom of the light guide as well. As a result of the roughened surfaces 50*c* of the inner light guides 50*b*, light entering the end of the light guides 50*b* will pass through the roughened surfaces 50*c* and will illuminate the liquid film F. It will be appreciated that a number of decorative enhancements may be employed using the light guides 50*b*. For example, the liquid L may be colored to display an illuminated colored liquid film F; the light source 45 may emit a variable color light to display a varying color film F; or the light source 45 from opposite sides of the device may emit synchronized or unsynchronized variable color lights.

FIG. 6 illustrates a transverse cross-sectional view of the single guide element 50 shown in FIGS. 1–4, showing a meniscus of liquid L from a water or aqueous liquid film F adhered thereto by surface tension. FIG. 8 illustrates a transverse cross-sectional view of an outer guide 51*a* and inner light guide 51*b* elements, showing the roughened surface 51*c* of the inner light guide 51*b*, and demonstrating an alternate shape of the outer guide element 51*a*. It should be noted that the shape of the outer guide element 51*a* is not of critical importance to the functionality of the waterfall 10. Fiber optic cable may have a diameter of about 0.25 to about 3 mm.

The arcuate portions 54, 64 of the guide elements 50, 60, may have various radii depending on the diameter of the guide elements. It has been found that the radius of the arcuate portions 54, 64 is not critical to the operability of the invention. The guide elements 50, 60 maybe made of metal or plastic, such as a copper metal rod or an acrylic plastic rod.

Figure 9:
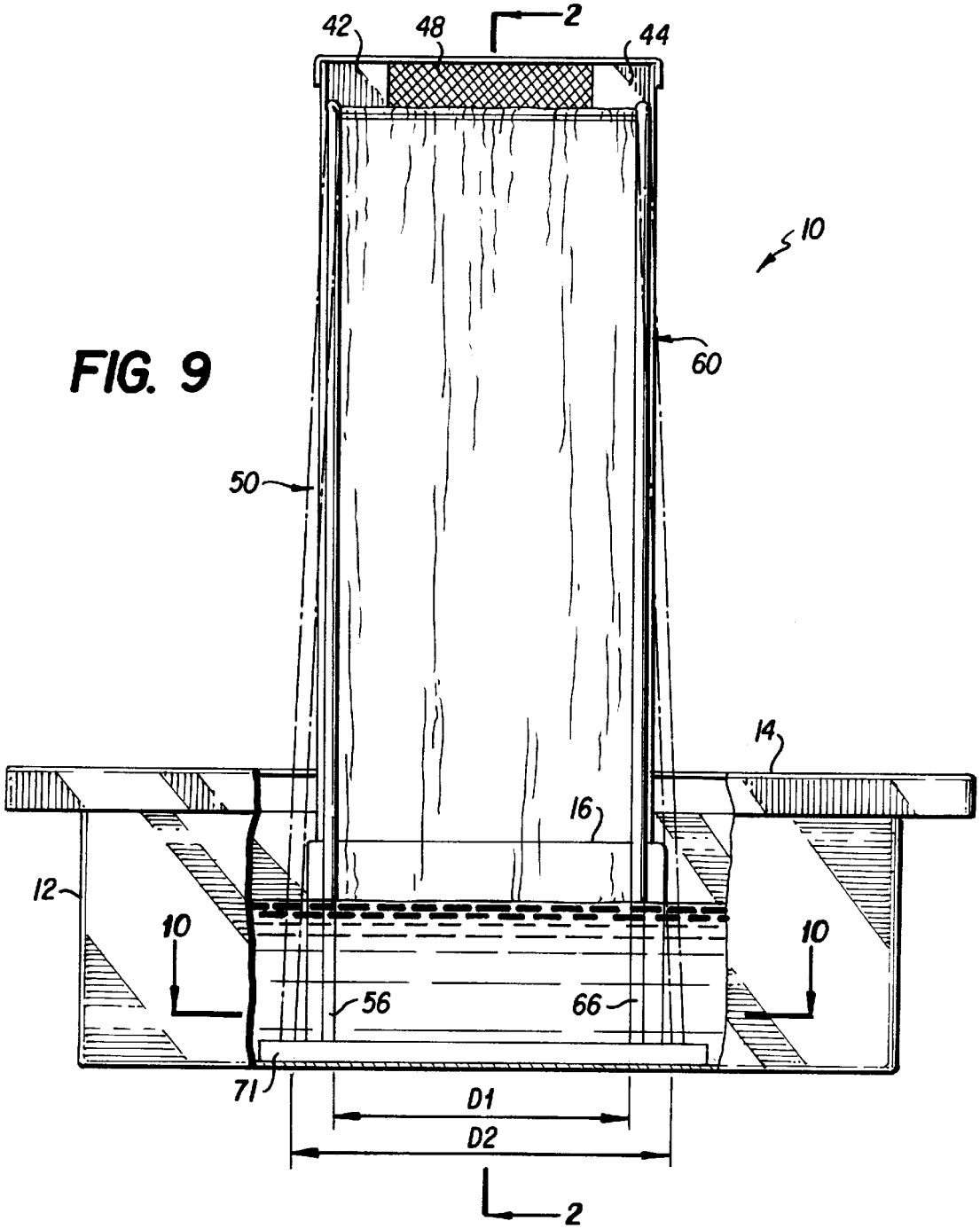
FIG. 9 is a front elevation view, partly broken, illustrating another feature of the first embodiment of the waterfall device of the present invention.
Figure 10:
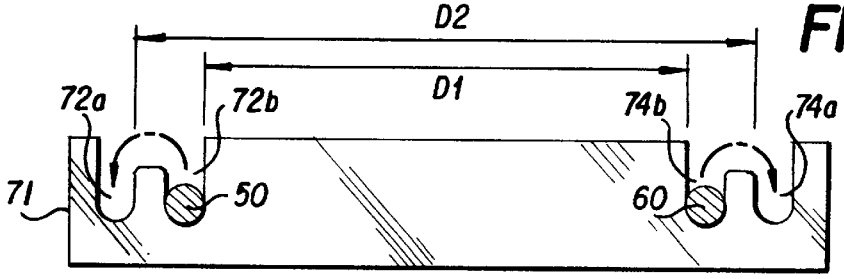
FIG. 10 is an top plan view of an alternate embodiment of the guide spacer of the waterfall device of the present invention taken along line 10—10 of FIG. 9.

Referring to FIGS. 9–10, there is shown in greater detail an arrangement of the guide elements 50, 60 with an alternate embodiment of a guide spacer 71. The guide elements 50, 60 may be arranged a distance of up to about six inches or more apart. The guide elements 50, 60 may be maintained in equidistant relation to one another at their upper end portions 52, 62 and lower end portions 56, 66 as shown in FIGS. 1–4. Alternatively, the guide elements 50, 60 may diverge or converge as they extend toward the base reservoir 12. A guide spacer 71 may be provided to mate with the guide elements 50, 60 with a plurality of guide channels 72*a*, 74*a*, 72*b*, 74*b* in which the lower end portions 56, 66 of the guide elements 50, 60 are located at different spacings D1 and D2.

Referring now in detail to FIGS. 11–15, there is shown another preferred embodiment of a waterfall 70 according to the invention. This alternate embodiment comprises a pump housing 16 connected to a pump plenum 17 into which a pump 20 (FIG. 14) pumps a liquid, such as water or an aqueous solution, under pressure from the pump outlet 22. The waterfall device 70 is placed in a base reservoir similar to base reservoir 12 shown in FIGS. 1–2. Two tubular guides 80, 90, each containing a passageway 82, 92 through which water or an aqueous liquid L can flow, and each having an upper end portion 84, 94 and a lower end portion 86, 96, are mounted at their lower end portions 86, 96 to the pump plenum 17 and extend upwardly for a distance of up to about 24 inches. The tubular guides 80, 90 are formed such that the upper end portions 84, 94 and lower end portions 86, 96 are substantially perpendicular to one another. The tubular guides 80, 90 are mounted and sealed in such a manner to the pump plenum 17 as to allow water or aqueous liquid to flow from the pump plenum 17 through the tubular guides 80, 90 without leaking.

Mounted approximately parallel to the upper end portions 84, 94 is a trough 30, the trough 30 having two side walls 32, 34, a rear wall 36, and a bottom wall 38 which terminates in a lip portion 40. As shown in FIG. 12, if the bottom wall 38 of the trough 30 is thicker than about 0.0625 inches, the lip portion 40 may be formed as a separate piece 41 no thicker than about 0.0625 inches, in order to prevent aqueous liquid L from adhering to the lip portion 40 and running down the underside of the bottom wall 38 of the trough 30. One or more restrictors 44*a*, 44*b*, 46*a*, 46*b* and one or more screens 48*a*, 48*b* are mounted within the trough 30, substantially perpendicular to the lip portion 40, such that the restrictors and screens are located within the flow path of the aqueous liquid L. In one preferred embodiment, inner guide elements 50*b*, 60*b* are attached to the tubular guides 80, 90 such that the inner guide elements 50*b*, 60*b* confront one another (FIG. 13). The tubular guides 80, 90 may be manufactured from transparent or opaque plastic or metal.

The restrictors 44*a*, 44*b*, 46*a*, 46*b* and screens 48*a*, 48*b* may be arranged in any order, so long as the restrictors and screens decrease the turbulence of the aqueous liquid L such that the flow of the liquid L is substantially laminar or non-turbulent.

Figure 14:
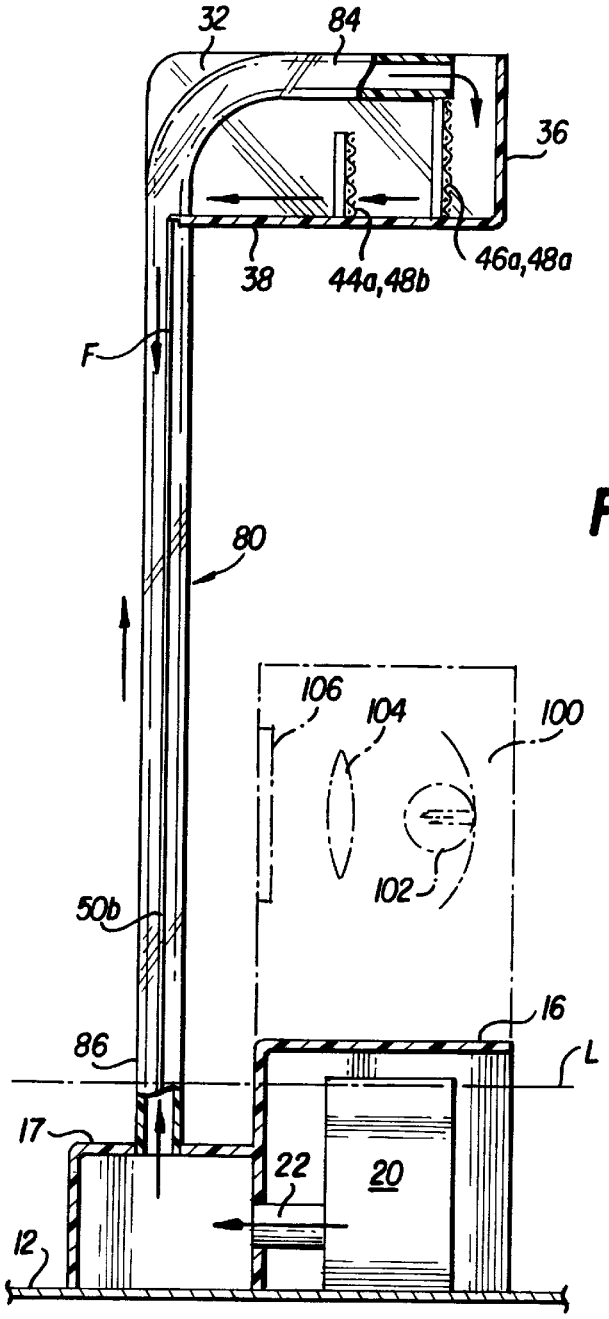
FIG. 14 is a side elevational view in cross-section of the second embodiment of the present invention taken along line 14—14 of FIG. 11.

Water or other aqueous liquid L contained in abase reservoir (not shown in FIG. 11) is pumped by pump 20 from the pump housing 16 through pump outlet 22 into the pump plenum 17 under pressure. From the pump plenum 17 the liquid L is pumped up through the tubular guide passageways 82, 92 and is discharged onto the trough 30 proximate to the rear wall 36 (FIG. 14). The liquid L then flows over the trough 30, around the restrictors 44*a*, 44*b*, 46*a*, 46*b*, through the screens 48*a*, 48*b* and over the lip portion 40 of the trough 30. The liquid L contacts and adheres to the guide elements 80, 90, maintaining a film F of liquid L between the guide elements 80, 90 until the liquid film F contacts the surface of the liquid L in the base reservoir. In this manner, the liquid L is continuously recycled, and maintains a continuous film F between the guide elements 80, 90.

In an alternative embodiment, only one inner guide element 50*b* is used, the inner guide element 50*b* being attached to one tubular guide 80 such that it confronts the other tubular guide 90. Additionally, one or both of the inner guide elements 50*b*, 60*b* may, as in the in the earlier-described embodiment, be fashioned from a fiber optic cable. The inner guide elements 50*b*, 60*b* may have roughened surfaces in order that light may pass through the roughened portion of the fiber optic cable through the aqueous liquid.

Figure 15:
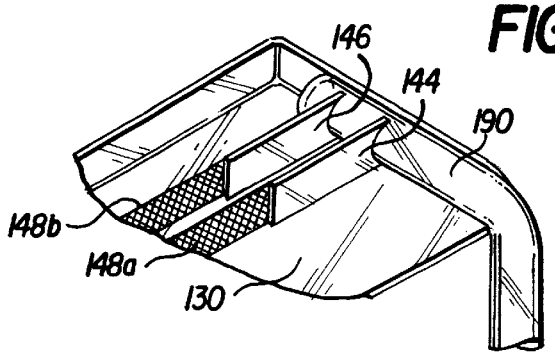
FIG. 15 is a fragmentary detail, showing an alternate embodiment of the trough of the second embodiment of the present invention illustrating the arrangement of the tubular guide and restrictor.

FIG. 15 illustrates an alternate embodiment of the construction of a trough 130 with a tubular guide 190 and restrictors 144, 146 and screens 148*a*, 148*b*. In this embodiment, the components except the screens 148*a*, 148*b* are preferably injection molded as a integral assembly. It will be apparent that the height of the trough 130 is substantially reduced over the trough 30 shown in FIG. 14.

FIG. 14 also illustrates an optional feature of the second embodiment of the invention. According to this option, a light fixture 100 is mounted on the pump housing 16 in spaced relation to the liquid film F extending between the guides 80, 90. Light fixture 100 comprise a light source 102, lens member 104, and an image transparency 106, which are arranged such that a visible image is projected from the transparency 106 onto the liquid film F between the tubular guides 80, 90.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What I claim is:

1. A device for forming a waterfall comprising a source of aqueous liquid, two upstanding liquid guides arranged in spaced relation to one another, said liquid guides having upper and lower end portions, a trough mounted adjacent the upper end portions of the liquid guides, a liquid flow member connected between the source of aqueous liquid and the trough, said trough having a lip portion over which aqueous liquid from the source of aqueous liquid flows in an aqueous liquid path in contact with the guides to form a substantially continuous aqueous liquid film extending between the liquid guides from the lip portion of the trough to the lower end portions of the guides, said liquid flow member comprising at least one of the liquid guides.

2. The device of claim 1, including a pair of restrictor members mounted on said trough in the aqueous liquid flow path and spaced from the lip portion of the trough.

3. The device of claim 1, including at least two screen members mounted on said trough in the aqueous liquid flow path spaced from one another and the lip portion of the trough end portions of the liquid guides for spacing the lower end portions of the liquid guides at a variable spacing from one another.

4. The decorative waterfall device of claim 1, including a decorative item disposed adjacent the substantially continuous aqueous liquid film so that the decorative item is visible through said film.

5. A device for forming a waterfall comprising a source of aqueous liquid, two upstanding liquid guides arranged in spaced relation to one another, said liquid guides having upper and lower end portions a trough mounted adjacent the upper end portions of the liquid guides, a liquid flow member connected between the source of aqueous liquid and the trough, said trough having a lip portion over which aqueous liquid from the source of aqueous liquid flows in an aqueous liquid path in contact with the guides to form a substantially continuous aqueous liquid film extending between the liquid guides from the lip portion of the trough to the lower end portions of the guides, said liquid guides comprising tubular members through which aqueous liquid from the source of aqueous liquid flows to the trough, and a pump connected between the source of aqueous liquid and the tubular members.

6. The device of claim 5, wherein said pump has an outlet and including an aqueous liquid plenum connected to the outlet of the pump, said tubular members being connected to said aqueous liquid plenum.

7. A decorative waterfall device comprising:

a base having an aqueous liquid reservoir for containing aqueous liquid;

an aqueous liquid tower having top and bottom ends and a passage therethrough, the bottom end of the tower being mounted on the base;

a pump arranged to pump aqueous liquid from the reservoir through the passage in the aqueous liquid tower;

a trough mounted at the top end of the aqueous liquid tower, said trough having an inlet connected to the passage in the aqueous liquid tower and a lip portion; and two liquid guides arranged in spaced relation to one another, said liquid guides having upper and lower end portions, the upper end portions of the liquid guides being mounted adjacent the lip portion of the trough and the lower end portions of the liquid guides extending downwardly toward the base whereby aqueous liquid pumped from the reservoir by the pump through the passage in the aqueous liquid tower flows in an aqueous liquid flow path from the inlet to the trough over the lip portion thereof to form a substantially continuous aqueous liquid film extending between the liquid guides from the lip portion of the trough to the lower end portions of the liquid guides, at least one liquid guide comprising a light guide having a surface confronting the aqueous liquid film being treated to permit light to pass therethrough into the aqueous liquid film and including a light source arranged to pass light through the light guide.

8. A device for forming a waterfall comprising a source of aqueous liquid, two upstanding liquid guides arranged in spaced relation to one another, said liquid guides having upper and lower end portions, a trough mounted adjacent the upper end portions of the liquid guides, a liquid flow member connected between the source of aqueous liquid and the trough, said trough having a lip portion over which aqueous liquid from the source of aqueous liquid flows in an aqueous liquid path in contact with the guides to form a substantially continuous aqueous liquid film extending between the liquid guides from the lip portion of the trough to the lower end portions of the guides, at least the lower portion of each liquid guide comprising first and second rods of circular cross-section and having longitudinal axes, said second rod having a diameter less than the diameter of the first rod, said first and second rods being disposed with the longitudinal axes thereof parallel to one another.

9. The device of claim 8, wherein the first and second rods contact one another, the rods of the liquid guides being disposed in a common plane containing the longitudinal axes of each rod and the aqueous liquid film.

10. The device of claim 9, wherein each second rod contacts the surface of a respective first rod on a side of said respective first rod confronting the other respective first rod.

11. The device of claim 10, wherein at least one of said second rods comprises a light guide having a surface confronting the aqueous liquid film being treated to permit light to pass therethrough into the aqueous liquid film and including a light source arranged to pass light through the light guide.

12. The device of claim 10, wherein said second rods comprise light guides having confronting surfaces, the confronting surfaces of said second rods being treated to permit light to pass therethrough into the aqueous liquid film and including light sources arranged to pass light through the light guides.

13. A decorative waterfall device comprising:

a base having an aqueous liquid reservoir for containing water;

two liquid guides arranged in spaced relation to one another extending upwardly from the base, said liquid guides having upper and lower end portions, at least one of the liquid guides comprising a tubular member;

a trough having a lip portion, the upper end portions of the liquid guides being mounted adjacent the lip portion of the trough;

a pump arranged to pump aqueous liquid from the reservoir through the tubular member to the trough whereby aqueous liquid discharged into the trough flows in an aqueous liquid flow path over the lip portion to form a substantially continuous aqueous liquid film extending between the liquid guides from the lip portion of the trough to the lower end portions of the liquid guides.

14. The decorative waterfall device of claim 13, including a decorative item disposed adjacent the substantially continuous aqueous liquid film so that the decorative item is visible through said film.

15. The decorative waterfall device of claim 13, including at least one screen member mounted on said trough in the aqueous liquid flow path and spaced from the lip portion of the trough.

16. The decorative waterfall device of claim 15, including a pair of restrictor members mounted on said trough in the aqueous liquid flow path and spaced from the lip portion of the trough.

17. The decorative waterfall device of claim 16, wherein the trough has a rear wall and a pair of side walls, the lip portion being arranged on an edge of the trough opposite the rear wall, one of the restrictor members extending from a respective side wall toward the other side wall, the screen member being arranged substantially parallel to the lip portion.

18. The decorative waterfall device of claim 13, including at least two screen members mounted on said trough in the aqueous liquid flow path spaced from one another and the lip portion of the trough.

19. The decorative waterfall device of claim 13, including a pair of restrictor members mounted on said trough in the aqueous liquid flow path and spaced from the lip portion of the trough.

20. The decorative waterfall device of claim 13, wherein at least one liquid guide comprises a light guide having a surface confronting the aqueous liquid film being treated to permit light to pass therethrough into the aqueous liquid film and including a light source arranged to pass light through the light guide.

21. The decorative waterfall device of claim 13, wherein each liquid guide has an intermediate arcuate portion between the upper and lower portions thereof, the upper and lower portions each having a longitudinal axis, the longitudinal axes of the upper and lower portions being disposed at substantially right angles to one another.

22. The decorative waterfall device of claim 21, wherein each liquid guide comprises a tubular member having a circular cross-section.

23. The decorative waterfall device of claim 13, wherein said base comprises an aqueous liquid plenum forming the aqueous liquid reservoir.

24. The decorative waterfall device of claim 23, wherein said aqueous liquid plenum, trough and liquid guides are made of a transparent plastic material.

25. The decorative waterfall device of claim 13, including a light source disposed adjacent the aqueous liquid film, a lens member and an image transparency arranged between the light source and the aqueous liquid film so that the light source projects a visible image from the image transparency onto the aqueous liquid film.

* * * * *